United States Patent [19]

Poggiali

[11] 4,046,309

[45] Sept. 6, 1977

[54] SHIPPING BOX

[75] Inventor: Lewis D. Poggiali, West Chester, Ohio

[73] Assignee: Olinkraft, Inc., West Monroe, La.

[21] Appl. No.: 703,708

[22] Filed: July 8, 1976

[51] Int. Cl.[2] ..... B65D 5/24; B65D 5/22

[52] U.S. Cl. ..... 229/23 R; 229/34 R; 229/31 FS; 229/36

[58] Field of Search ..... 229/34 R, 35, 36, 31 FS, 229/23 R

[56] References Cited

U.S. PATENT DOCUMENTS

| | | | |
|---|---|---|---|
| 1,600,260 | 9/1926 | Walter | 229/36 |
| 2,151,472 | 3/1939 | Hubbard | 229/31 FS |
| 2,357,155 | 8/1944 | Williams et al. | 229/35 |
| 2,358,614 | 9/1944 | Arbuthnot | 229/23 R |
| 2,758,781 | 8/1956 | White | 229/34 R X |
| 3,207,414 | 9/1965 | Locke et al. | 229/36 |
| 3,471,077 | 10/1969 | Kitchell | 229/34 R |
| 3,536,249 | 10/1970 | Houston | 229/34 R |
| 3,883,067 | 5/1975 | McGlynn et al. | 229/31 FS |

*Primary Examiner*—Davis T. Moorhead
*Attorney, Agent, or Firm*—O'Brien & Marks

[57] ABSTRACT

A shipping box capable of holding a coolant, such as ice, for the shipment of items requiring refrigeration including fish, perishable foods and the like. The box includes an outer container, an inner container, and a lid secured together as an integral unit.

7 Claims, 9 Drawing Figures

FIG. 8
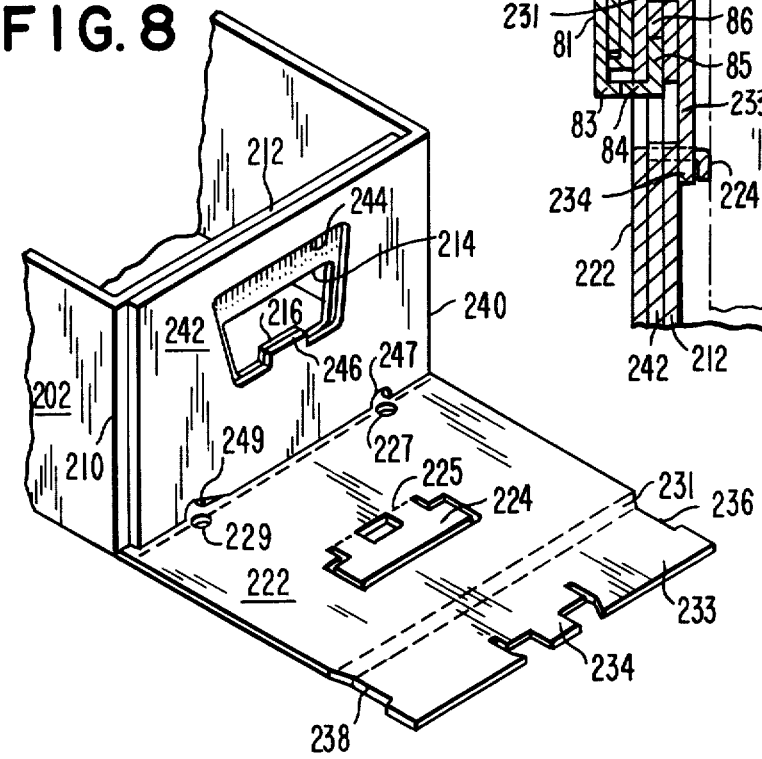
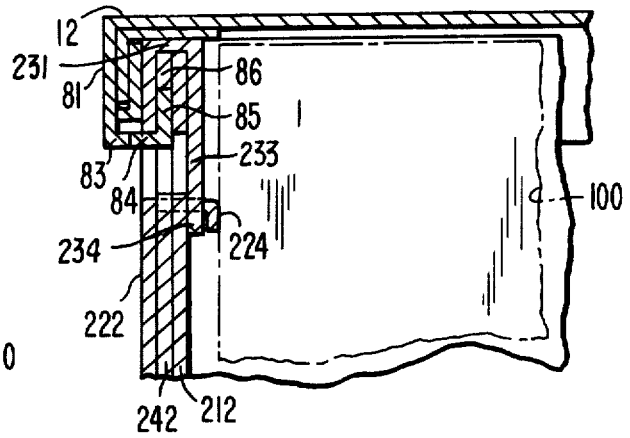
FIG. 9
FIG. 7
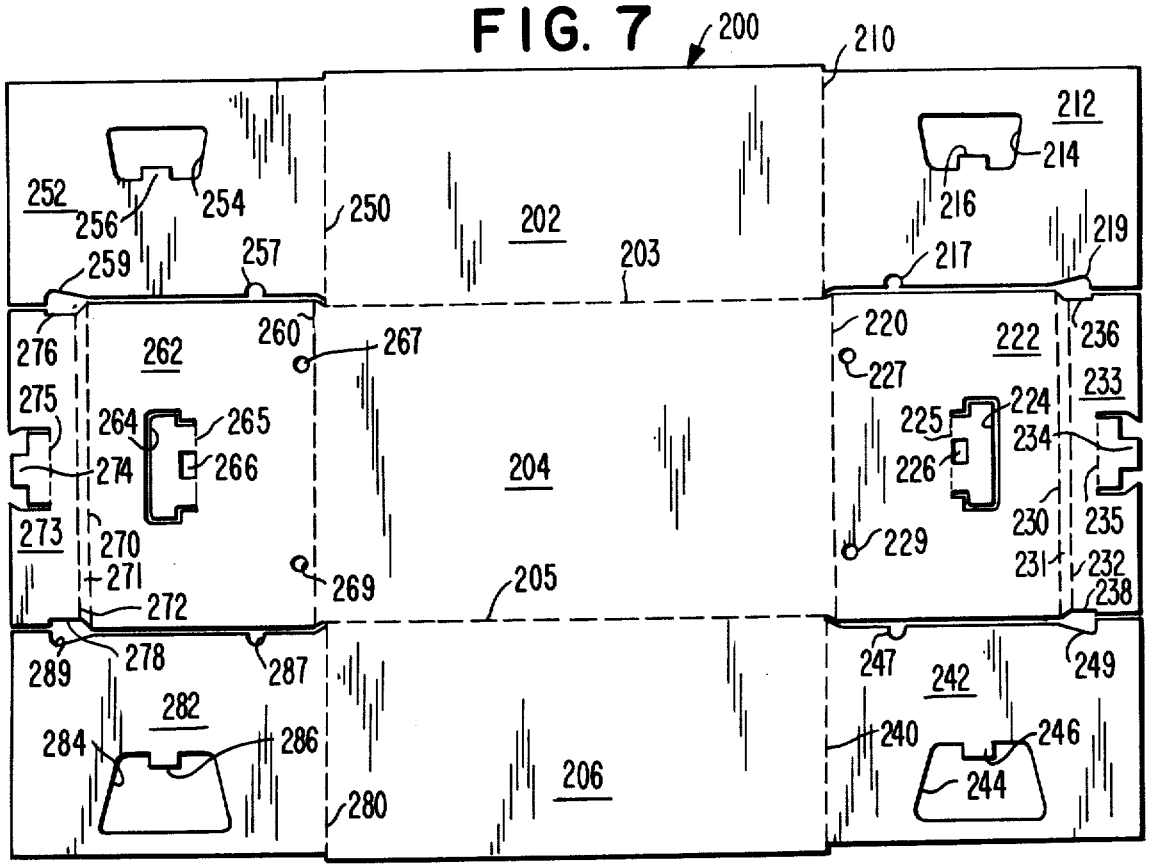

SHIPPING BOX

BACKGROUND OF THE INVENTION

1. Field of the Invention

The present invention relates to a shipping box, and in particular to a shipping box having multiple containers especially constructed for the shipment of items requiring refrigeration, such as fish packed in ice.

1. Description of the Prior Art

The prior art, as presented by U.S. Pat. No. 2,358,614, is cognizant of a shipping box constructed from a plurality of interfitting containers having a lid which is interlocked with such containers for handling purposes.

SUMMARY OF THE INVENTION

The present invention is summarized in a shipping box including a generally rectangular inner container having a bottom panel, side end panels integral with the bottom panel and a top panel integral with the side panels, the top panel having folded end portions overlying the end panels, interlocking means between the end portions and the end panels to latch the inner container in a closed position, a generally rectangular outer container having a bottom wall, spaced side walls integral with the bottom wall and spaced end walls integral with the bottom wall, each end wall including three sections disposed in juxtaposition to each other, a handle opening in each of the three sections and in alignment with each other, locking tab means on one of the three sections extending through the other two sections to lock all three sections together as a unit, the said one section having a folded panel portion disposed contiguous another of the three sections, a flap projecting from the panel portion and engaging the locking tab means to keep the same in a locked position, and a lid covering top portions of the inner and outer containers.

An object of the present invention is to construct a shipping box in a simple, economical manner so as to be capable of carrying heavy loads.

This invention has another object in that the multiple containers of a shipping box are formed from interlocking walls and panels.

It is another object of the present invention to lock three end wall sections of a container by a locking tab and by a flap to secure the locking tab.

Other objects and advantages of the present invention will become apparent from the following description taken in conjunction with the accompanying drawings.

BRIEF DESCRIPTION OF THE DRAWINGS

FIG. 7 is a plan view of a blank showing the unfolded condition of the outer container of FIG. 1;

FIG. 8 is a partial isometric view of a detail of the outer container of FIG. 7; and FIG. 9 is a partial cross section of the box of FIG. 1 showing a detail thereof.

DESCRIPTION OF THE PREFERRED EMBODIMENT

Figure 1:
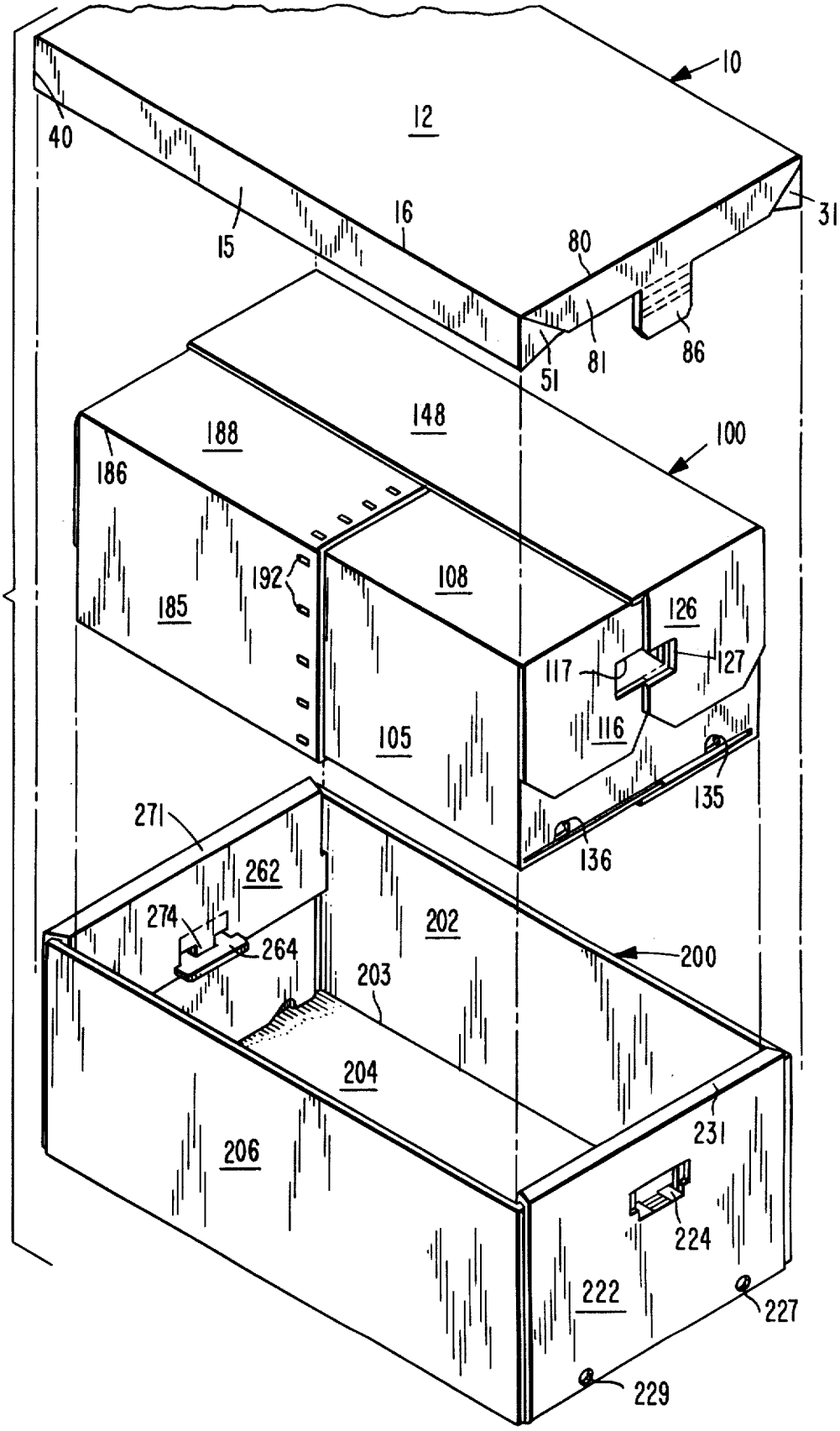
FIG. 1 is an exploded isometric view with parts broken away of a shipping box embodying the present invention.

As is illustrated in FIG. 1, the present invention is embodied in a shipping box having a lid, an inner container and an outer container. The lid, indicated generally at 10, has a central panel 12 with a pair of side panels, the side panels 13 and 15 are folded along score lines 14 and 16, respectively, so as to be perpendicularly disposed to the central panel 12. As is viewed in FIG. 3, a score line 20 permits a left end flap 21 to be folded perpendicularly to the side panel 13. The end flap 21 is tapered or reduced along its lower edge from the score line 20 to a point intermediate its length with its outermost end defining a necked-down portion. A score line 22 perpendicular to but not joining the score line 20 permits an end tab 24 to be folded perpendicular to the end flap 21. Intermediate its length and contiguous the score line 22 the end tab 24 has a rectangular cut out 26 for a purpose to be described hereinafter. The score line 22 represents an extension of the score line 14 but is offset therefrom by a short sloping score line 28.

Figure 3:
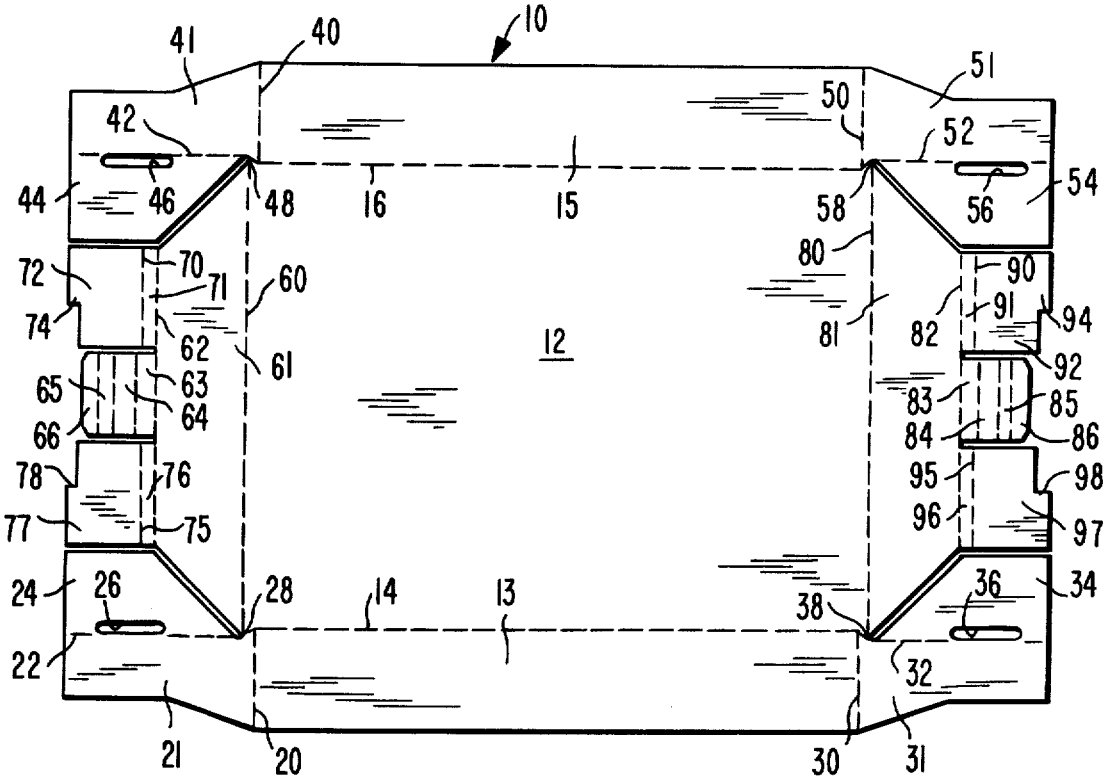
FIG. 3 is a plan view of a blank showing the unfolded condition of the lid of FIG. 2.

As is viewed in FIG. 3, a similar end flap is carried on the right end of side panel 13 in a mirror image arrangement to the left end flap. Accordingly, for the sake of brevity the specific structure is not being described again but merely mentioned with the appropriate reference numerals appended: score line 30, right end flap 31, score line 32, end tab 34, cut out 36; and sloping score line 38.

The upper side panel 15, as viewed in FIG. 3, with its two end flaps 41 and 51 is a mirror image of the lower side panel 13 with its end flaps 21 and 31 so that a complete description of the specific structure of side panel 15 is being omitted for the sake of brevity. Thus, the particular elements are merely being mentioned with the appropriate reference numerals appended: score lines 40 and 50, left and right end flaps 41 and 51, score lines 42 and 52, end tabs 44 and 54, cut outs 46 and 56, and sloping score lines 48 and 58.

Figure 2:
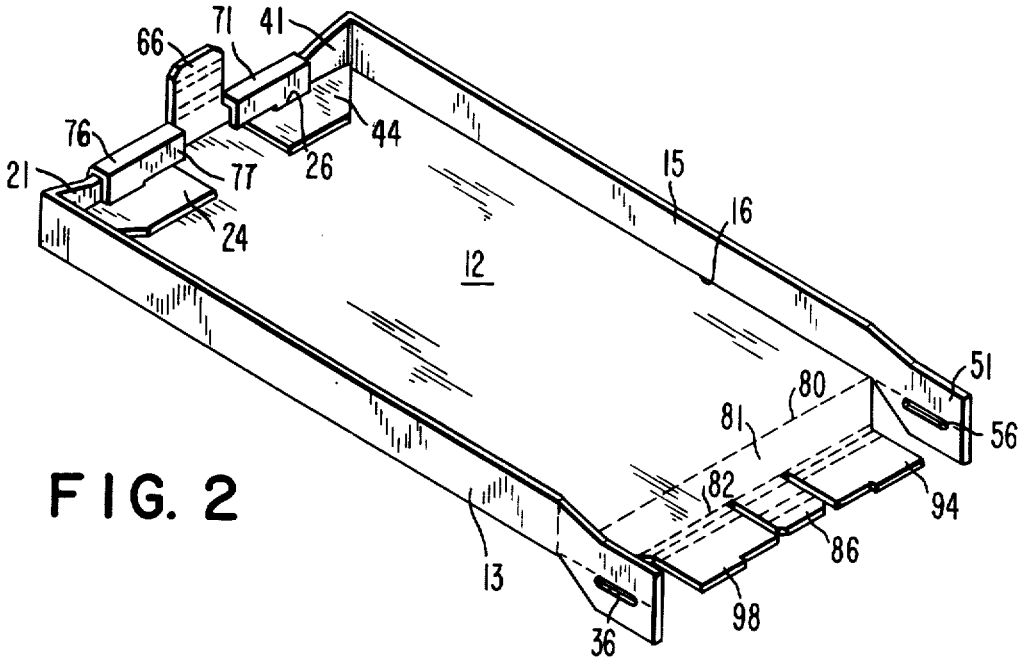
FIG. 2 is an isometric view of the box lid of FIG. 1 in a partially folded condition.

A score line 60 between the central panel 12 and a left end panel 61 permits folding thereof in perpendicular relationship to the central panel 12. The left end panel 61 has a generally trapezoidal configuration as viewed in FIG. 3, with a score line 62 defining the shorter edge of the trapezoid. Centrally extending from the score line 62 and being disposed perpendicular thereto is a handlock tab which includes three score lines equally spaced from each other and the score line 62 so as to form four tab sections 63, 64, 65 and 66 which are folded successively perpendicular to each other. Adjacent one side of the tab sections and parallel to score line 62 is another score line 70 defining a panel 71 therebetween and a second panel 72 parallel to left end panel 61 so as to form a generally inverted U-shaped configuration as viewed in FIG. 2. The free edge of panel 72 has a ledge 74 which fits in the cut out 46 to lock the end tab 44 in position. Adjacent the other sides of the tab sections is a score line 75, panel 76, second panel 77 and ledge 78, all of which are identical in structure and function to the score line 70, panel 71, second panel 72 and ledge 74 as described above.

As viewed in FIG. 3, the elements associated with the right end panel are a mirror image of those of the left end panel so that the specific elements are not described for the sake of brevity but are merely mentioned with the appropriate reference numerals attached: score line 80, right end panel 81, score line 82, tab sections 83, 84, 85 and 86, score lines 90, 95, panels 91, 96, second panels 92, 97, and ledges 94, 98.

Figure 5:
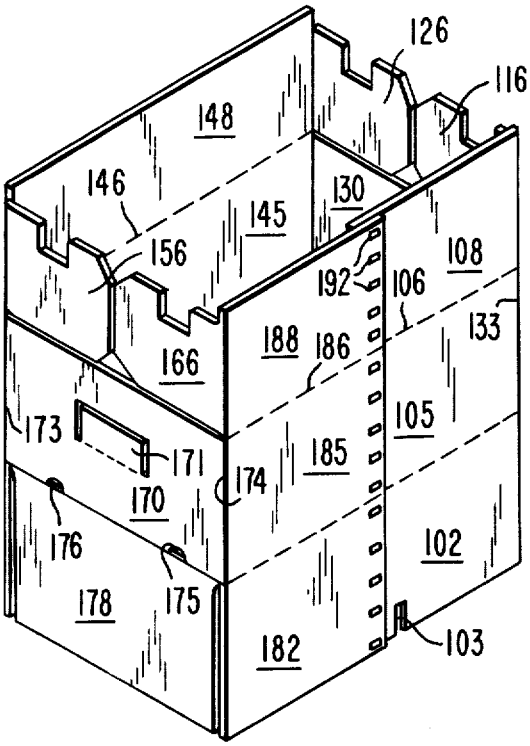
FIG. 5 is an isometric view of the inner container of FIG. 4 in a partially folded condition.
Figure 4:
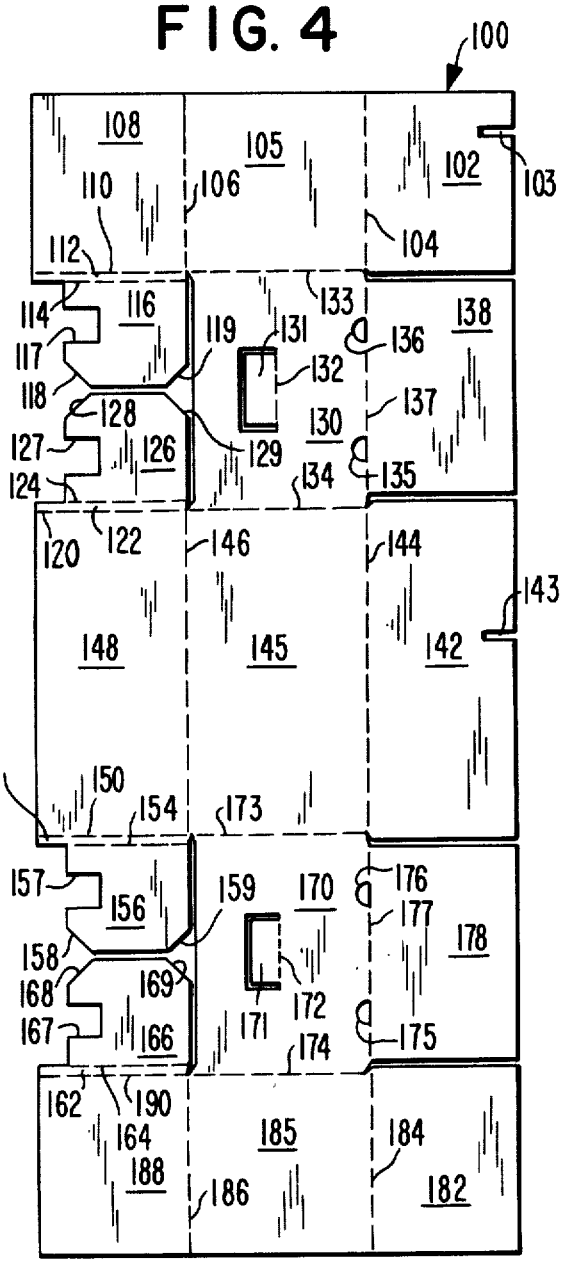
FIG. 4 is a plan view of a blank showing the unfolded condition of the inner container of FIG. 1.

The inner container 100 is a multi-paneled arrangement folded into a generally rectangular configuration having bottom, middle and top panels constructed from a single blank of material. As is illustrated in FIGS. 4 and 5, a first bottom right side panel 102 is notched with a slot 103 in its lower edge and a score line 104 which permits folding of the panel 102 perpendicularly to a first middle right side panel 105. A score line 106 foldingly separates the panel 105 from a first top right side panel 108 which has a score line 110 perpendicular to and intersecting the score line 106.

A thin section 112 and score line 114 are parallel to the score line 110 permitting a first right end top panel 116 to be folded perpendicular to the top right side panel 108. A generally square shaped cut out 117 is intermediately disposed in the upper edge (FIG. 5) of the panel 116. The edge of panel 116, which is opposite its score line 114, is cut away at its upper and lower edges to define sloping corners 118 and 119, respectively. A second right end top panel is a mirror image of the first, so it will not be described in detail but the elements are merely being mentioned with their appropriate reference numerals: score line 120, thin section 122, score line 124, second right end top panel 126, square shaped cut out 127, upper sloping corner 128, and lower sloping corner 129.

A middle right end panel 130 has a generally centrally located interlocking arrangement which includes a rectangular folded section 131 bendable along score line 132. Score lines 133 and 134 permit the panel 130 to be folded perpendicular to the middle right side panel 105 and to an opposite middle left side panel 145. Along its lower edge, the panel 130 is provided with spaced apertures 135 and 136 for venting and/or leaking purposes, this lower edge defines a score line 137 whereby a bottom right end panel 138 is folded perpendicular to the panel 130.

Panels 142, 145 and 148 of FIG. 4 define the left side of the inner container 100 as viewed in FIG. 5. The left side bottom panel 142 is notched with a slot 143 in its lower edge and a score line 144 (in spaced parallel relation to such lower edge) permits folding of the panel 142 perpendicularly to the middle left side panel 145. A score line 146 foldingly separates the panel 145 from the top left side panel 148. As is shown in FIG. 4, the score line 120 permits folding of the panel 148 perpendicular to the thin section 122.

The left end panels 156, 166, 170 and 178 include the same components as the right end panels 116, 126, 130, and 138, respectively so they are not being described in detail but merely mentioned with their appropriate reference numerals: score line 150, thin section 152, score line 154, first left end top panel 156, cut out 157, sloping corners 158 and 159; thin section 162, score line 164, second left end top panel 166, cut out 167, sloping corners 168 and 169; middle left end panel 170, folded section 171, score lines 172, 173 and 174, spaced apertures 175 and 176, score line 177, and bottom left end panel 178.

Figure 6:
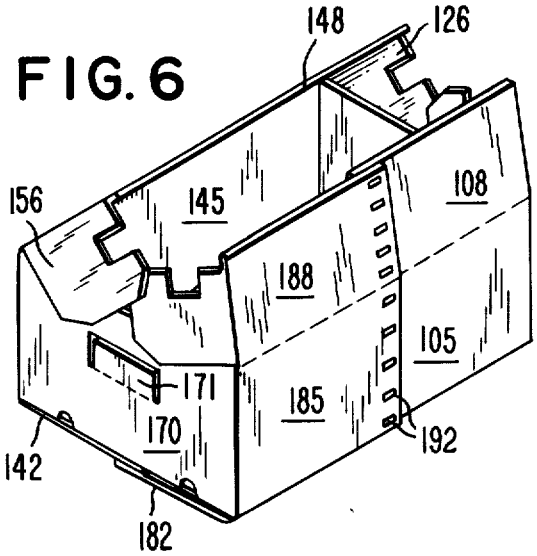
FIG. 6 is an isometric view of the inner container of FIG. 5 in a more completed folded condition.

The second parts of the right side panels, which are substantially the same as the first right side panels 102, 105 and 108, are not being described in detail but are merely mentioned with appropriate reference numerals: second bottom right side panel 182, score line 184, second middle right side panel 185, score line 186, second top right side panel 188, and score line 190. As is illustrated in FIGS. 5 and 6, the second parts of the right side panels are larger in width than the first parts so that their adjacent portions overlap; suitable fastening means, such as staples 192, join the overlapping portions.

The outer container, indicated generally at 200, is a multi-walled arrangement folded into a generally rectangular configuration having side, end and bottom panels constructed from a single blank of material. As is illustrated in FIGS. 7 and 8, a first side wall 202 has a score line 203 foldingly separating it from a bottom wall 204. A score line 205 foldingly separates the bottom wall 204 from a second side wall 206 oppositely disposed to the first side wall 202.

A score line 210 foldingly separates the first side wall 202 from a right first end wall 212 having a generally trapezoidal opening 214. A projection 216 extends into the opening 214 from the smaller side of the trapezoid. Spaced apertures 217 and 219 are located in the lower edge of end wall 212 for venting and/or leaking purposes.

A score line 220, parallel to but slightly spaced from the score line 210 foldingly separates the bottom wall from a right third end wall 222 having a generally T-shaped folded portion 224 folded along a score line 225. Intermediate and contiguous the score line 225, the folded portion 224 has a generally rectangular cut out 226. A pair of spaced apertures 227 and 229 are located adjacent but spaced from the score line 220 which represents the lower edge of the wall 222 in its assembled condition. A score line 230 in spaced parallel relation to the score line 220, permits perpendicular folding of a top edge 231; a second score line 232 parallel to the score line 230 defines a fold line for a return wall 233 whereby the walls 222, 231 and 233 define an inverted U-shaped arrangement. A generally T-shaped tab 234 extending from a score line 235, is intermediately located along the free edge of return wall 233; a cut out surrounding the exposed edges of the tab 234 is defined by a pair of opposed edge points which aid in latching cooperation with the folding portion 224 in its assembled condition. A pair of edge cut outs 236 and 238 in the respective upper and lower side edges (as viewed in FIG. 7) of the walls 231 and 233 facilitate folding thereof to form the inverted U-shaped arrangement.

A right second end wall, which is substantially the same as the right first end wall 212, is not being described in detail but the components thereof merely being mentioned with appropriate reference numerals: score line 240, right second end wall 242, trapezoidal opening 244 (slightly larger than opening 214), projection 246, and spaced apertures 247 and 249.

As is apparent from FIG. 7, the left end including first, second and third end walls is a mirror image of the right end. Accordingly, again for the sake of brevity, the specific details of the left end are not being separately described but are merely being mentioned with appropriate reference numerals: score line 250, left first end wall 252, trapezoidal opening 254, projection 256, spaced apertures 257 and 259; score line 260, left third end wall 262, folded portion 264, score line 265, cut out 266, spaced apertures 267 and 269, score line 270, top edge 271, score line 272, return wall 273, tab 274, score line 275, edge cut outs 276 and 278; score line 280, left second end wall 282, trapezoidal opening 284, projection 286, and spaced apertures 287 and 289.

The lid 10, inner container 100 and outer container 200 are made of corrugated paper which is curtain coated on both sides and is wax impregnated.

The outer container is assembled by folding the side walls 202 and 206 along their respective score lines 203 and 205 in perpendicular relation to the bottom wall 204. The right first and second end walls 212 and 242 are folded along their respective score lines 210 and 240 to be in surface contact with each other and perpendicular to the bottom wall 204 and the side walls 202 and 206. The third end wall is folded along its score line 220 so as to be in surface contact with the second end wall 242. At this point, the folded portion 224 is bent along its score line 225 so as to extend through the end wall openings with the projections 216 and 246 extending through the cut out 226; the return wall 233 is folded against the inside of the first end wall 212 and its tab 234 extends through the same cut out 226. During the insert of the tab 234, the edges of the folded portion 234 are locked behind the pointed edges of the return wall 233. It is to be understood that the left end of the outer container 200 is assembled in a similar manner resulting in a container that is erected into a usable condition without the need of tape, staples, or other type of fasteners.

The inner container 100 is folded into a rectangle (FIG. 5) with the overlapping portions of the side panels secured together by staples 192. The bottom of the inner container is formed by folding the bottom end panels 138 and 178 toward each other so that they are perpendicular to their side and end panels. The bottom side panels 102–182 and 142 are folded toward each other with their overlapping portions interlocked by engagement of the two slots 103 and 143. The top of the inner container is formed by folding the top side panels 108–188 and 148 toward each other until the edge of top side panel 148 overlaps (see FIG. 1) the adjacent edges of the top side panels 108 and 188. The first and second right end panels 116 and 126 are folded in opposed relation to each other and are disposed along the outside of the middle right end panel 130; inasmuch as the cut outs 117 and 127 face each other, they cooperate to form a unitary rectangular opening adjacent and in alignment with the opening defined by the folded section 131 and the openings 214 and 244. It is to be understood that the left end of the inner container 100 is assembled in a similar manner resulting in a container that is erected into a usable self-supporting condition.

The lid 10 is assembled by folding the side panels 13 and 15 perpendicular to the central panel 12. The end tab 24 is folded along its score line 22 so as to be perpendicular to the end flap 21 which is folded along its score line 20 so as to be perpendicular to the side panel 13; thus the end tab 24 is disposed in surface contact with the adjacent portion of the central panel 12. The other three end tabs 34, 44 and 54 are similarly positioned.

The left end panel 61 is folded along its score line 60 so as to be perpendicular to the central panel 12; because of the offsets or sloping score lines 28 and 38, the panel 61 is on the outside of the end flap 21. The first and second panels 76 and 77 are folded along their respective score lines 62 and 75 so that the first panel 76 covers the unsloped edge of end flap 21 and the second panel 77 is in surface contact with the inside surface of the adjacent part of the end flap 21. The assembly is locked in place by the ledge 78 of the second panel 77 extending into the cut out 26 of the end tab 24. The other three first and second panels 71–72, 91–92 and 96–97 are similarly positioned to complete the assembly of the lid 10 as shown in the left end of FIG. 2.

The lid 10, the inner container 100 and the outer container 200 are assembled as a unit by inserting the inner container 100 into the outer container with their respective leakage apertures aligned with each other to result in four sets of leakage apertures. In addition, the handle openings at each end of the shipping box are aligned with respect to the inner and outer containers. The folded portions 224 and 264 are slightly deformed by the inner container 100 as is illustrated in FIG. 9 so as to present a friction fit between the inner and outer container. The lid 10 is now placed over the top of the assembled inner and outer containers in a press fitted manner and the tab sections 83, 84, 85 and 86 are folded along their respective score lines to form a generally U-shaped configuration. Such tab sections are inserted through the aligned handle openings in the end walls 222 and 242 with the two tab sections 85 and 86 engaging the surface of end wall 212 (see FIG. 9). Because the inner container 100 has an aligned handle opening 117–127, the two tab sections may alternately be inserted through the handle opening 117–127 so as to lock the lid 10 and the containers 100 and 200 as a unitary assembly. Thus during lifting the tab sections 83, 84, 85 and 86 will engage the adjacent parts of inner and outer containers 100 and 200 to assure non-separation of the units during handling; in addition, the handle portions of the tab sections and of the inner and outer containers are constructed to withstand excessive pressure during handling when the shipping box is loaded.

Because of the strength and insulation characteristics of the shipping container, it is advantageously adaptable for the shipment of poultry, fish, etc. that requires some type of refrigeration as by carbon dioxide, ice, etc. In one particular arrangement, the present shipping box is especially useful in the shipment of fish. The inner container 100 is placed in the outer container 200 in an open condition and is filled with 2 to 3 inches of crushed ice. A layer of fish is then placed on top of the ice, then a layer of ice, etc. until filled. The fish are thus displaced from the bottom of the inner container because during shipment they start to deteriorate and give off a body slime which must be allowed to drain out through the leakage apertures along with water from the melting ice. After the inner container 100 has been filled, its top panels are closed and the lid 10 set on top and locked into place by the tab sections 83, 84, 85 and 86.

During the shipment of fish, it is often necessary to re-ice the shipping box before it reaches its final destination. To accomplish such re-icing, the lid 10 is removed, the inner and outer containers are inverted and the outer container 200 removing by lifting it; the inner container is opened by lifting the bottom side panels 142 and 102–182 causing separation of the slot lock 103–143 and then lifting the bottom end panels 138 and 178. The ice is added to the bottom section of the inner container 100, which is closed in a reverse opening sequence; the outer container is placed over the inner container and the lid is applied with the shipping box being again inserted to its original upright position. As a further assurance of sufficient strength and insulation, the outer container may be constructed from an asphalt corrugated medium.

Inasmuch as the present invention is subject to many variations, modifications and changes in detail, it is intended that all matter contained in the foregoing description or shown on the accompanying drawings shall be interpreted as illustrative and not in a limited sense.

What is claimed is:

1. In a shipping box, the combination comprising a generally rectangular inner container having a bottom panel, side and end panels integral with the bottom panel, and a top panel integral with the side panels, said top panel including a pair of left and right parts folded toward each other and a pair of folded end portions integral with said pair of parts and overlying said end panels, interlocking means between said end portions and said end panels to latch said inner container in a closed position, said interlocking means including an opening in each pair of said portions and a folded section on each end panel extending through said opening adjacent thereto, said bottom panel including a pair of panel elements folded toward each other and having edges which overlap each other, a generally rectangular outer container having a bottom wall, spaced side walls integral with the bottom wall, and spaced end walls integral with the bottom wall, each end wall including three sections disposed in juxtaposition to each other, a handle opening in each of said three sections and in alignment with each other, locking tab means on one of said three sections and extending through the openings of the other two sections to lock all three sections together as a unit, said one section including a folded panel portion disposed contiguous another of said three sections, a flap projecting from said panel portion and engaging said locking tab means to keep the same in a locked position, a lid covering top portions of said inner and outer containers, and a handle extension on each end of said lid extending into the handle opening of its adjacent end wall.

2. The invention as recited in claim 1 wherein there is a slot in each of the overlapping edges of the panel elements, and the overlapping edges of said pair of panel elements are secured together by engagement of said slots.

3. The invention as recited in claim 1 wherein said locking tab means comprises a folded tab in alignment with said folded section.

4. The invention as recited in claim 1 wherein each handle extension is generally U-shaped and engages the opening in its adjacent end portion to lock the inner and outer containers with the lid.

5. The invention as recited in claim 4 wherein said lid includes side panels and end panels surrounding the upper portions of said inner and outer containers.

6. The invention as recited in claim 5 wherein said inner container has a plurality of vent holes, said outer container has a plurality of vent apertures, and wherein said vent holes and vent apertures are in alignment with each other.

7. The invention as recited in claim 6 wherein said shipping box is constructed of corrugated paper material having a wax impregnation throughout and being curtain-coated to improve box strength and insulating characteristics.

* * * * *